United States Patent [19]

Norman

[11] 3,930,372

[45] Jan. 6, 1976

[54] METHOD AND ARRANGEMENT FOR CONTROLLING THE POSITION OF AN UNDERGROUND MANHOLE ASSEMBLY

[75] Inventor: Stanley William Norman, Seattle, Wash.

[73] Assignee: Johns-Manville Corporation, Denver, Colo.

[22] Filed: Nov. 28, 1973

[21] Appl. No.: 419,742

[52] U.S. Cl. ..... 61/46; 61/11; 61/41; 61/50; 52/21; 52/169; 404/5

[51] Int. Cl.[2] ..... E02D 29/12; E02D 27/00

[58] Field of Search ..... 61/50, 46, 11, 13, 81, 61/82, 41, 40, 35; 52/169, 21, 20; 404/5

[56] References Cited

UNITED STATES PATENTS

| | | | |
|---|---|---|---|
| 261,649 | 7/1882 | Apple | 52/20 X |
| 311,299 | 1/1885 | Elliott | 61/41 |
| 782,383 | 2/1905 | Doty | 61/81 X |
| 1,639,495 | 8/1927 | Frame | 52/20 |
| 3,172,377 | 3/1965 | Dewar | 52/169 |
| 3,345,826 | 10/1967 | Hignite | 61/41 |
| 3,530,677 | 9/1970 | Ede | 61/41 |
| 3,672,103 | 6/1972 | Kost | 52/169 X |
| 3,759,280 | 9/1973 | Swanson | 52/21 |

FOREIGN PATENTS OR APPLICATIONS

| | | | |
|---|---|---|---|
| 96,732 | 1/1961 | Netherlands | 61/41 |

*Primary Examiner*—Jacob Shapiro

*Attorney, Agent, or Firm*—Robert M. Krone; Stephen C. Shear

[57] ABSTRACT

A method and arrangement for preventing an underground manhole assembly from moving upwards in response to a change in soil conditions beneath the assembly are disclosed herein. For example, in the event the soil directly beneath the assembly includes substantial moisture and in the event this moisture freezes, the latter expands against the base of the assembly and in many cases pushes the assembly in an upward direction. The method and arrangement disclosed herein eliminates this upward movement by the utilization of a pressurized fluid barrier which is maintained between the manhole assembly and the soil directly beneath the assembly.

15 Claims, 2 Drawing Figures

METHOD AND ARRANGEMENT FOR CONTROLLING THE POSITION OF AN UNDERGROUND MANHOLE ASSEMBLY

BACKGROUND OF THE INVENTION

1. Field of the Invention

The present invention is directed generally to underground manhole assemblies and more particularly to a method and arrangement for preventing the assembly from moving upwards in response to a change in surrounding soil conditions.

2. Discussion of the Prior Art

As is generally known, manhole assemblies are often provided as a juncture for joining underground sewer pipes which extend in different directions therefrom. Typically, a manhole assembly will include a base which sits directly against the soil beneath it. In relatively dry or warm climates, the soil surrounding the manhole assembly and particularly the soil beneath its base will remain in an unfrozen and/or unexpanded state. However, in moist climates where freeze and thaw conditions prevail, moisture directly beneath and directly against the manhole assembly tends to freeze, causing the soil to expand in an upward direction against the base of the manhole assembly. This, in turn, can force the assembly towards ground level.

When the frozen soil thaws, the side pressures exerted against the assembly prevent the ladder from moving back to its original position and eventually there is further soil build-up beneath the base. Hence, at the next freeze period, this procedure is repeated. While each increment of upward movement of the assembly is small, after many freeze-thaw cycles, the entire manhole assembly can move upwards a substantial distance.

The foregoing creates two major problems. Firstly, if the manhole assembly is located beneath a street or sidewalk, which is generally the case, upward movement of the assembly can cause substantial damage to the street or sidewalk. This, of course, can create hazardous conditions. Secondly, since the manhole acts as an extension or juncture to sewer pipes, substantial movement of the manhole produces misalignment which, in turn, interferes with the otherwise smooth flow through the sewer pipes. This, in turn, can produce a pressure problem within the sewer pipes and also can create a static condition within the latter, causing sewage to settle in the manhole, thereby creating a maintenance problem.

The aforedescribed freeze-thaw conditions can also exist along the sides of the manhole assembly. In this regard, many manhole assemblies are constructed in sections which are stacked on top of one another. It has been discovered that ice along the periphery of a given section of the assembly, during the freeze cycle, grips the assembly section as the ice expands and raises the section upward. As this occurs, gravel and/or other debris may collect between the raised section and the section directly below it, preventing the raised section from returning to its normal position. After many freeze-thaw cycles, the overall upward movement of any given manhole section may be substantial, resulting in the same problems discussed above.

BRIEF SUMMARY OF THE INVENTION

An object of the present invention is to provide an underground manhole assembly which is especially suitable in moist climates including seasonal freeze-thaw conditions.

Another object of the present invention is to provide an underground manhole assembly which is not forced towards ground level in response to changes in freeze-thaw conditions under the assembly.

A further object of the present invention is to provide a method for preventing cyclic freeze-thaw soil conditions beneath an underground manhole assembly from forcing the latter to ground level.

The foregoing objects, as well as other objects and features, are achieved by the present invention which provides a method and arrangement for preventing changes in soil conditions beneath an underground manhole assembly from forcing the latter toward ground level. In this regard, manhole assemblies generally include an underground base, a lid readily accessible from ground level and underground sidewall means, all of which together cooperate to define the manhole. In accordance with one aspect of the present invention, a pressurized fluid barrier, preferably an air barrier, is provided between the base of the manhole assembly and the unfrozen soil beneath the base. In the event any moisture which is located beneath the barrier, either alone or within the soil, freezes and expands, it will expand into the barrier and not directly against the base. Hence, no appreciable upwardly directed forces will be applied against the manhole assembly for otherwise forcing the ladder toward ground level.

Some manhole assemblies are constructed in sections, as stated above. In accordance with another aspect of the present invention, in the event one or more of these sections are moved toward ground level by freeze conditions along their periphery, gravel and other foreign matter is prevented from entering between the raised section or sections and adjacent lower sections. Hence, during the thaw cycle, the raised section can readily return to its original position.

DETAILED DESCRIPTION AND PREFERRED EMBODIMENTS

Figure 1:
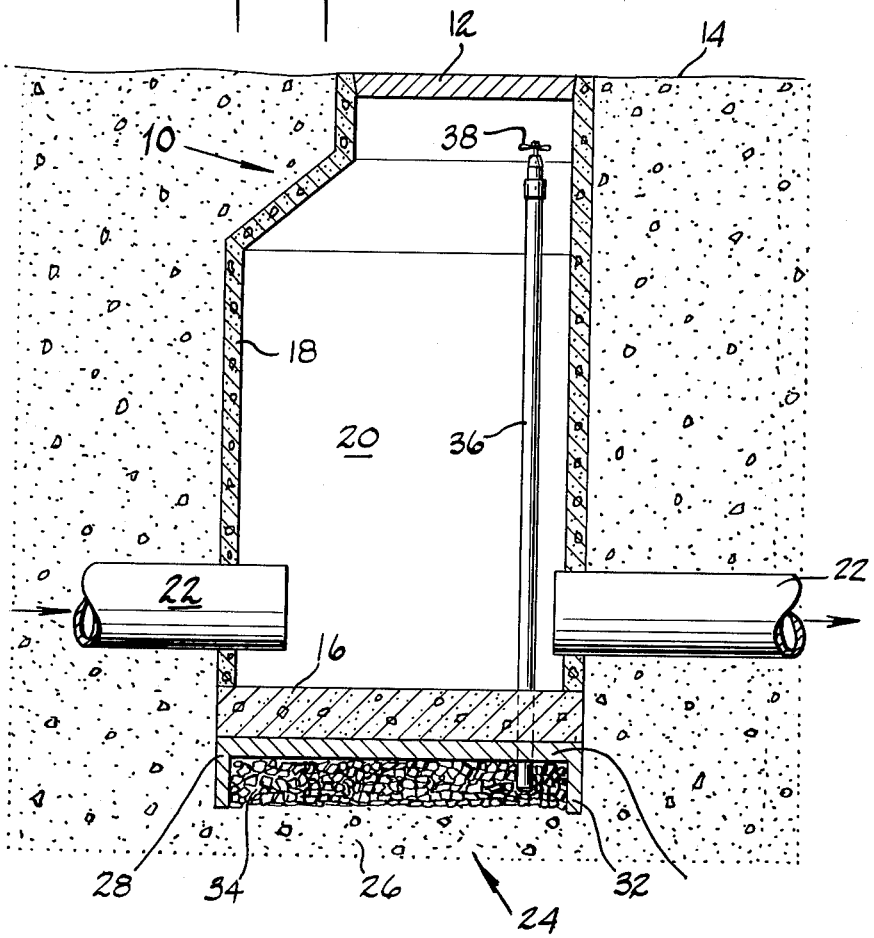
FIG. 1 is a vertical sectional view illustrating an underground manhole assembly constructed in accordance with the present invention.

Turning to the drawing, FIG. 1 illustrates an underground manhole assembly which is constructed in accordance with the present invention and which is generally designated by the reference numeral 10. The assembly typically includes a lid 12 positioned at ground level (generally designated by the reference numeral 14), a base 16 located below the lid and a substantial distance from ground level and continuous sidewall means 18. Together, the lid 12, base 16 and sidewall means 18 define a manhole 20 which acts as a juncture between incoming and outgoing sewer pipes 22, as illustrated in FIG. 1. In this manner, any sewage which is to pass from one sewer pipe to the other sewer pipe, flows through the manhole.

In accordance with the present invention, assembly 10 includes an arrangement 24 for preventing a change in soil conditions beneath base 16 from forcing the base, sidewall means and lid upwards. More specifically, during wet but warm climatic conditions, water and/or water containing soil, generally designated soil 26, resides beneath base 16. During a freezing period, this water and/or water containing soil 26 freezes up and expands. As will be seen hereinafter, arrangement 24 prevents this expansion from producing any appreciable forces against base 16 of manhole assembly 10 and therefore prevents upward movement of the latter in response to such changes in the soil condition.

To achieve the foregoing and in accordance with a preferred embodiment of the present invention, arrangement 24 includes a pan-like member 28 comprising a top side 30 and a circumferential sidewall 32 formed around the periphery of the top side. As illustrated, the top side is positioned below and against the bottom of base 16 such that the sidewall 32 extends downwardly therefrom. In this regard, the top side is preferably at least approximately as large as the base so as to engage against substantially the entire bottom surface of the base.

With pan-like member 28 in the aforedescribed position, the top side 30 and sidewall 32 together define a chamber 34 which is opened to soil 26. In fact, initially the water and/or water containing soil may be at least partially located within the chamber. After the pan-like member has been initially positioned under base 16, and while the water and/or water containing soil is in an unfrozen state, fluid under pressure, preferably air, is directed into chamber 34 with sufficient pressure to prevent the soil in the chamber from resting directly against top side 30, thereby creating a pressurized barrier between the top side and the unfrozen soil. In this regard, sidewall 32 should be of sufficient depth to provide a substantially deep barrier between base 30 and the soil. In addition, there should be sufficient soil around the sidewall to prevent the pressurized air from appreciably leaking under the sidewall and out of the chamber.

To produce the barrier, arrangement 24 preferably includes a conduit 36 located within the manhole 20, through base 16 and the top side 30 of the pan-like member and into the chamber 34. The conduit, as illustrated, can include one outlet point within the chamber or may be designed to include a plurality of outlet points spaced throughout chamber 34 so as to more uniformly apply the pressurized air to the chamber. In addition, the conduit includes a shut-off valve 38 to prevent the pressurized air within the chamber from escaping therethrough. In this connection, as long as the soil 26 is sufficiently non-porous so as to prevent the pressurized air from escaping from chambers 34 therethrough, the pressurized barrier may be maintained for a long period of time, for example, months.

The exact amount of pressure required in creating and maintaining the aforedescribed barrier within chamber 34 will depend upon several factors. One such factor is the size of the barrier, that is, the volume of space to be pressurized between the soil 26 and top side 30 within the chamber. Another factor is the amount of force, i.e., air pressure, required in maintaining the water and/or water containing soil away from top-side 30 while water and/or water containing soil is in an unfrozen state. The specific depth of the barrier must, of course, be sufficient to allow expansion of the soil during a freeze without the soil applying any appreciable forces directly against top side 30 and therefore against base 16. In other words, the barrier must be sufficiently deep to allow the soil to expand into it without appreciably engaging against top side 30. These specific factors and therefore the required air pressure can be readily determined in view of the teachings of the present invention.

In actual operation, when manhole assembly 10 including arrangement 24 is initially installed, which obviously should be done in warm climatic conditions or at least in non-freezing conditions, some soil 26 will probably be located within the chamber 34. This soil should be initially located or otherwise forced away from top side 30. Once the assembly is in position, air is applied through the conduit 36 with sufficient pressure to force or, in any case, maintain this soil away from top side 30 to produce the barrier of the desired depth. The pressure must, or course, be sufficient to maintain this barrier during non-freeze conditions. Now, in the event the soil does freeze, it will expand into the barrier and not directly against the top side. Hence, this will eliminate the application of substantial forces against the top side which would otherwise tend to force the base upwardly towards ground level. In this regard, in order to prevent pan-like member 28 from slipping laterally relative to base 16, coarse gravel 35 or other such means may be provided in the chamber 34 to hold the member in place. The gravel or other such means must, however, be sufficiently coarse to provide spaces between individual components. These spaces must be of sufficient size and quantity to maintain the aforedescribed barrier and allow expansion of soil 26 into the spaces.

In summarizing the foregoing, the pressurized barrier prevents unfrozen water and/or water containing soil within chamber 34 from directly contacting the top side 30 of inverted pan 28. Hence, when the water and/or water containing soil does freeze and expand upwardly, it expands into the barrier and not directly against the pan and manhole assembly generally. During this expansion, it should be noted that the pressure within the chamber 34 will increase slightly or some of the pressurized air forming the aforedescribed barrier may escape through soil or through a one-way release valve (not shown) which may be provided for this purpose. Hence, after the freeze cycle and after the soil has thawed, introduction of further pressurized air in the chamber may be necessary.

Figure 2:
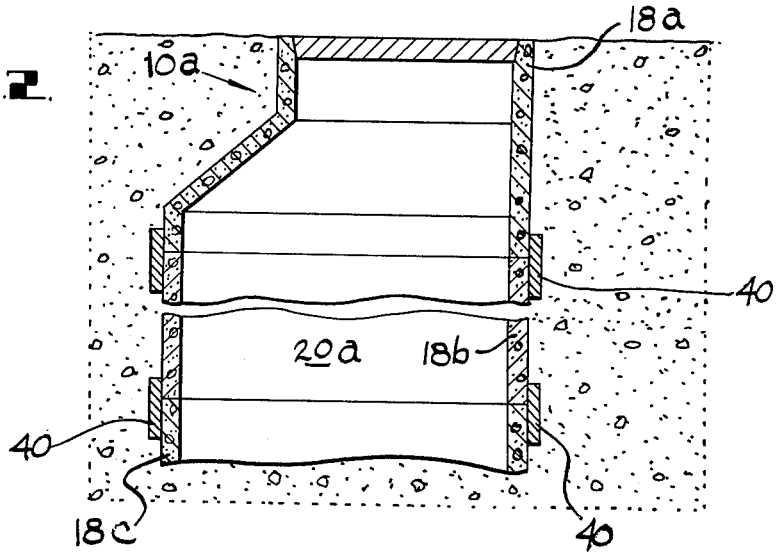
FIG. 2 is a vertical sectional view of a portion of a manhole assembly which is constructed in accordance with the present invention and which includes a plurality of sections.

As stated above, manhole assemblies are often constructed in sections. As illustrated in FIG. 2, a portion of a manhole assembly 10*a* is shown. Assembly 10*a*, unlike assembly 10, is comprised of a plurality of subsections 18*a*, 18*b*, 18*c* and so on, depending on the number of such subsections. These subsections are positioned in an aligned stack so that together they define a manhole 20*a*.

As also stated above, if the soil around the aforedescribed subsections freezes, this frozen soil during expansion may tend to grip and raise one of the subsections, for example subsection 18*a*, upwardly creating a space between this subsection and the next lower subsection, for example subsection 18*b*. If this occurs, gravel, soil or other such matter can move between the subsection, preventing the raised one from returning to its initial position during a subsequent thaw period. Repeated freeze-thaw cycles may produce substantial upward movement of the subsections of assembly 10*a*.

In accordance with the present invention, each of the subsections of assembly 10*a*, except for example the lower most subsection, includes a circumferential skirt 40 which is of a shape corresponding to the periphery of an associated subsection. As illustrated in FIG. 2, each skirt extends around and is preferably suitably fixed (not shown) to the lower end portion of its associated subsection and depends a predetermined distance from the lower end thereof. Hence, with the subsections positioned in an aligned stack, as shown, the skirt associated with, for example, subsection 18*a* extends below this subsection and around a top portion of subsection 18*b*.

From the foregoing, it should be apparent that if, for example subsection 18*a* is forced upward due to a freeze, its associated skirt 40 will also move upward. In this respect, the associated skirt must depend a sufficient distance from the lower end of subsection 18*a* so as to maintain the resulting space between this subsection and subsection 18*b* closed from external matter. This, in turn, prevents foreign matter from entering between the two subsections and thus allows the raised subsection to return to its original position during a subsequent thaw period. Therefore, repeated freeze thaw cycles will not produce cumulative raising of the subsections.

It should be apparent that the skirts could be connected with the tops of their respective subsections and extend upwardly therefrom to produce the aforedescribed results. In this case, the lowermost subsection would include a skirt and the uppermost subsection would, for example, not require a skirt. Assembly 10*a* may, of course, include an arrangement 24 in addition to skirts 40. In fact, a manhole assembly comprised of subsections may include only air arrangement 24.

What is claimed is:

1. In an underground manhole assembly including an underground base, a lid readily accessible from ground level and underground wall means which together cooperate to define a manhole, the improvement comprising:

a. an arrangement at least partially positioned between the base of said manhole assembly and soil beneath said base, said arrangement including air under pressure between said base and said soil.

2. In an assembly according to claim 1 wherein said arrangement includes fluid conveyance means for aiding in providing said air under pressure after said arrangement is in said position.

3. In an assembly according to claim 1 wherein said arrangement includes a pan-like member having a closed top, side wall means formed around the periphery of said top and an opened bottom, said pan-like member being positioned under and against said base so that its opened bottom faces towards the soil beneath said base.

4. In an assembly according to claim 3 including means for preventing said pan-like member from moving in a transverse direction relative to said base.

5. In an assembly according to claim 1 wherein said underground wall means is comprised of a plurality of circumferential sections which are positioned in an aligned vertical stack, said improvement including at least one circumferential skirt extending around one of said sections and having a circumferential portion depending from the lower end of said one section, said depending portion extending around on the upper portion of an adjacent lower section.

6. In an assembly according to claim 5 wherein said skirt is connected, with one of said last-mentioned sections.

7. In an underground manhole assembly including an underground base, a lid readily accessible from ground level and underground wall means which together cooperate to define a manhole, the improvement comprising:

a. a first means defining a chamber between the base of said manhole assembly and the soil beneath said base;

b. fluid under pressure provided within said chamber for preventing said soil and any liquids in said soil from substantially completely filling said chamber; and c. second means for conveying said fluid into said chamber.

8. In an assembly according to claim 7 wherein a. said fluid is air, b. said first means includes a pan-like member positioned against and below said base and having a closed top side, side wall means formed around said top side and an opened bottom, said opened bottom facing said soil so that said member defines said chamber between said soil and the top side of said member, and c. said second means includes an air conduit means positioned through said base and said top side and means for closing the passage through said conduit.

9. In an assembly according to claim 8 including coarse aggregate matter located within said chamber for preventing said pan-like member from shifting relative to said base, said matter being of sizes and shapes to provide pockets therebetween for the presence of said air under pressure.

10. In an underground manhole assembly including an underground base, a lid readily accessible from ground level and underground wall means which together cooperate to define a manhole, a method of preventing the soil beneath the base of said assembly from forcing the base upwards in response to the moisture in said soil freezing and expanding, said method comprising:

a. providing a chamber between said base and the soil beneath said base; and b. applying fluid under pressure to said chamber so as to define a pressurized fluid barrier between said base and soil, said barrier being of sufficient depth to prevent said soil, when in an unfrozen state, from contacting said base and to prevent said soil from applying any appreciable force on said base due to a freeze in any moisture in the soil.

11. A method according to claim 10 wherein said fluid under pressure is directed into said chamber with sufficient pressure to maintain said barrier so long as the moisture in said soil is in an unfrozen state.

12. A method according to claim 11 wherein said fluid is periodically directed into said chamber so as to maintain said sufficient pressure.

13. A method according to claim 12 wherein said fluid is air.

14. In an assembly according to claim 2 wherein said conveyance means is located within said manhole.

15. In an underground manhole assembly including an underground base, a lid readily accessible from ground level and underground wall means which together cooperate to define a manhole, the improvement comprising:

a. an arrangement at least partially positioned between the base of said manhole assembly and soil beneath said base, said arrangement including air under pressure between said base and said soil beneath said base for preventing said soil, when in an unfrozen state, from contacting said base and for preventing said soil from applying any appreciable force to said base due to a freeze in any moisture in said soil.

* * * * *